US010713951B2

(12) United States Patent
Raaijmakers

(10) Patent No.: US 10,713,951 B2
(45) Date of Patent: Jul. 14, 2020

(54) METHOD FOR CHECKING A PASSING POSSIBILITY CONDITION

(71) Applicant: AUDI AG, Ingolstadt (DE)

(72) Inventor: Marvin Raaijmakers, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 16/343,144

(22) PCT Filed: Oct. 19, 2017

(86) PCT No.: PCT/EP2017/076671
§ 371 (c)(1),
(2) Date: Apr. 18, 2019

(87) PCT Pub. No.: WO2018/073330
PCT Pub. Date: Apr. 26, 2018

(65) Prior Publication Data

US 2019/0318627 A1 Oct. 17, 2019

(30) Foreign Application Priority Data

Oct. 20, 2016 (DE) ..... 10 2016 220 583

(51) Int. Cl.
*G08G 1/16* (2006.01)
*G08G 1/0962* (2006.01)

(52) U.S. Cl.
CPC ..... *G08G 1/166* (2013.01); *G08G 1/09623* (2013.01); *G08G 1/09626* (2013.01)

(58) Field of Classification Search
CPC .. G01S 13/931; G08G 1/09623; G08G 1/052; G08G 1/161; G08G 1/166;
(Continued)

(56) References Cited

U.S. PATENT DOCUMENTS

2005/0125121 A1* 6/2005 Isaji ..... G08G 1/166 701/36
2005/0246096 A1 11/2005 Bracht et al.
(Continued)

FOREIGN PATENT DOCUMENTS

DE 3622447 C1 1/1988
DE 102004018681 A1 11/2005
(Continued)

OTHER PUBLICATIONS

International Search Report and Written Opinion of the International Searching Authority directed to related International Patent Application No. PCT/EP2017/076671, dated Sep. 26, 2018, with attached English-language translation; 15 pages.
(Continued)

*Primary Examiner* — Hoi C Lau
(74) *Attorney, Agent, or Firm* — Sterne, Kessler, Goldstein & Fox P.L.L.C.

(57) ABSTRACT

The discloser relates to a method for checking a passing possibility condition, which is fulfilled if a passing process for the passing of a preceding vehicle by a motor vehicle is presumably possible, wherein ego data relating to the driving operation of the motor vehicle and, by means of at least one surroundings sensor of the motor vehicle, surroundings data relating to a stretch of road ahead are detected, whereupon preceding-vehicle data relating to the preceding vehicle are ascertained on the basis of the surroundings data, whereupon on the basis of the preceding-vehicle data and the ego data, a piece of passing information is ascertained, which describes a minimum required driving distance of the motor vehicle along the stretch of road under specific boundary conditions, which is required for passing the preceding vehicle, whereupon the passing possibility condition is evaluated on the basis of the passing information and, if the presence of a road user in a passing lane usable
(Continued)

in conjunction with the passing process is ascertained from the surroundings data, on the basis of a piece of road user information describing said road user, wherein when no road user is detected in the passing lane, the passing possibility condition is fulfilled only if the required driving distance is shorter by a shortening amount than the length of a stretch section of the stretch of road detectable by the surroundings sensor.

14 Claims, 2 Drawing Sheets

(58) Field of Classification Search
CPC ..... G08G 1/09626; B60W 10/184; B60W 10/15; B60W 30/0956; B60W 30/09
See application file for complete search history.

(56) References Cited

U.S. PATENT DOCUMENTS

2008/0059037 A1* 3/2008 Isaji ..... B60W 40/072 701/93
2013/0338877 A1* 12/2013 Straus ..... G08G 1/161 701/41
2015/0029042 A1* 1/2015 Ikeya ..... G08G 1/052 340/934
2015/0344033 A1 12/2015 Fukuda et al.
2017/0341652 A1* 11/2017 Sugawara ..... G01S 13/931
2019/0318627 A1* 10/2019 Raaijmakers ..... G08G 1/09623

FOREIGN PATENT DOCUMENTS

DE 102004027695 A1 11/2005
DE 102010010557 A1 1/2011
DE 102014002116 A1 8/2015
DE 102015209952 A1 12/2015
WO WO-2016/104042 A1 6/2016
WO WO-2016104042 A1 * 6/2016 ..... B60W 50/14

OTHER PUBLICATIONS

International Search Report and Written Opinion of the International Searching Authority directed to related International Patent Application No. PCT/EP2017/076671, dated Jan. 30, 2018, with attached English-language translation; 24 pages.

* cited by examiner

METHOD FOR CHECKING A PASSING POSSIBILITY CONDITION

TECHNICAL FIELD

The present application relates to a method for checking a passing possibility condition as well as a motor vehicle.

BACKGROUND

Driver assistance systems are known, which assist a driver when assessing a passing process. The publication DE 36 22 447 C1, for example, teaches a device for displaying passing recommendations. Vehicles to pass and oncoming vehicles are located by means of a radar unit and it is ascertained from these vehicles and from variables associated with the host vehicle whether a passing process with or without additional acceleration is or is not possible. A maximum available passing lane is ascertained from the data of the oncoming vehicles. If there are no oncoming vehicles, the range of the radar device is assumed to be an available path for passing.

The problem in this case is that in some driving situations, the driver is displayed an possibility to pass when in fact a passing process should not be carried out.

DETAILED DESCRIPTION

Figure 1:
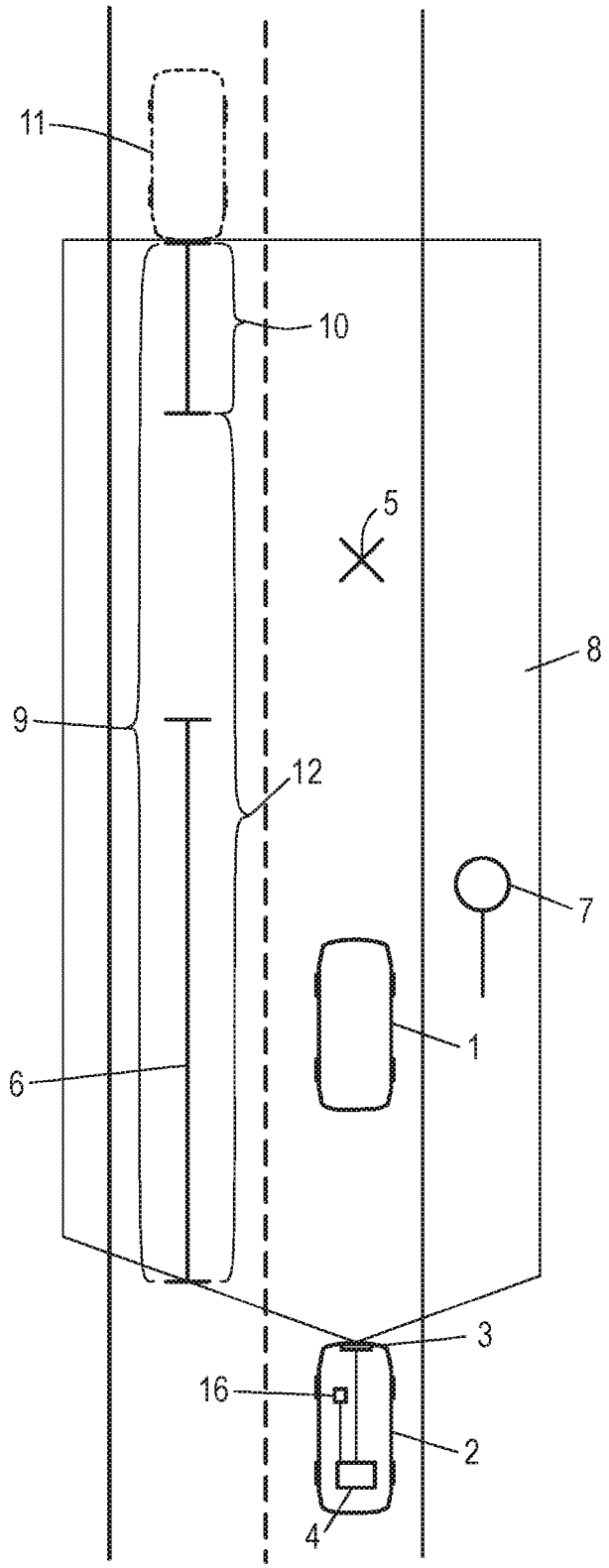
FIG. 1 shows a driving situation on a straight stretch of road.

The present application relates to a method for checking a passing possibility condition, which is fulfilled if a passing process for the passing of a preceding vehicle by a motor vehicle is presumably possible, wherein ego data relating to the driving operation of the motor vehicle and, by means of at least one surroundings sensor of the motor vehicle, surroundings data relating to a stretch of road ahead are detected, whereupon preceding-vehicle data relating to the preceding vehicle are ascertained on the basis of the surroundings data, whereupon on the basis of the preceding-vehicle data and the ego data, passing information is ascertained, which describes a minimum required driving distance of the motor vehicle along the stretch of road under specific boundary conditions which is required for passing the preceding vehicle, whereupon the passing possibility condition is evaluated on the basis of the passing information and, if the presence of a road user on a passing lane usable in the passing process is determined from the surroundings data, on the basis of a piece of road user information describing said road user. The application also relates to a motor vehicle.

Driver assistance systems are known, which assist a driver when assessing a passing process. The publication DE 36 22 447 C1, for example, teaches a device for displaying passing recommendations. Vehicles to pass and oncoming vehicles are located by means of a radar unit and it is ascertained from these vehicles and from variables associated with the host vehicle whether a passing process with or without additional acceleration is or is not possible. A maximum available passing lane is ascertained from the data of the oncoming vehicles. If there are no oncoming vehicles, the range of the radar device is assumed to be an available path for passing.

The problem in this case is that in some driving situations, the driver is displayed an possibility to pass when in fact a passing process should not be carried out.

By comparison, the object of the application, therefore, is to improve the robustness of a passing recommendation.

The object is achieved according to the application in that in a method of the aforementioned kind, when a road user is detected in the passing lane, the passing possibility condition is fulfilled only if the required driving distance is shorter by a shortening amount than the length of a stretch section of the stretch of road detectable by the surroundings sensor.

Thus, a safety interval having the length of the shortening amount between the driving distance is provided, which is presumably required for passing, and the length of the detectable stretch section. A road user located outside the detection zone of the surroundings sensor may enter this safety interval without disrupting the passing process. With a driving situation-related specification of the shortening amount, as is explained later in detail, it may be ensured that the passing possibility condition is fulfilled only if in fact a passing is also very likely.

The surroundings sensor utilized is preferably at least one radar sensor. In addition or alternatively, cameras may, for example, be utilized, in particular, time-of-flight cameras, laser scanners or the like. Road users in the passing lane may be considered to be, in particular, oncoming motor vehicles in the method according to an embodiment of the invention. It is also possible, however, that the road user is driving in the same driving direction as the motor vehicle, but at a lower speed.

The ego data of the motor vehicle may, in particular, be a speed of the motor vehicle, an instantaneous acceleration and/or a maximum possible acceleration. The preceding-vehicle data may describe a speed of the preceding vehicle or a relative speed of the preceding vehicle relative to the motor vehicle and, in particular, an acceleration of the preceding vehicle. In addition, the preceding-vehicle data may describe a length of the preceding vehicle and/or the preceding vehicle may be classified by the preceding-vehicle data, in particular, in order to ascertain a maximum possible acceleration.

The passing information ascertained may exclusively require driving distance, in particular, a length of the passing lane that is presumably utilized in conjunction with the passing process. It is also possible, however, that the passing information ascertained is a trajectory of the motor vehicle for the passing process. The corresponding variables may be ascertained in such a way that it is assumed that the preceding vehicle is driving at a constant speed or with a constant acceleration or with a projected maximum acceleration. From these variables, it may be ascertained when at a given speed and with a possible or instantaneous acceleration the motor vehicle may return to the current driving lane again ahead of the preceding vehicle.

Boundary conditions may be considered to be, for example, minimal distances of the motor vehicle to the preceding vehicle, a length of the host motor vehicle and/or maximum allowable driving speeds on the stretch of road, which are not to be exceeded or maximally exceeded by a prescribed amount in conjunction with the passing process.

In principle, it is possible to fixedly predefine the shortening amount. Preferably, however, the shortening amount is predefined on the basis of a maximum allowable driving speed. A maximum allowable driving speed may be detected, for example, by recognizing road signs in the instantaneous or previously detected surroundings data, which limit the maximum allowable driving speed. Alternatively or in addition, a maximum allowable driving speed may be derived from map data. For this purpose, an ego position of the motor vehicle may be detected by a position detection device, for example, a GPS sensor, and map data stored in the motor vehicle may, for example, be evaluated in order to ascertain the maximum allowable driving speed at the ego position. A shortening amount based on the maximum allowable driving speed is expedient, since it may be assumed from this that oncoming motor vehicles that enter the detection zone of the surroundings sensor are presumably moving at a driving speed that does not exceed, or exceeds by only a predefined amount, the maximum allowable driving speed. The shortening amount may be calculated by ascertaining a time requirement for the driving distance required for the passing process and by multiplying this time requirement by the allowable driving speed or by the sum of the allowable driving speed and the predefined amount.

In conjunction with the evaluation of the passing possibility condition, an existence of a virtual road user may be assumed, which is located outside the detectable stretch section at the beginning of the passing process, and which moves at a predefined speed or at a predefined speed profile in the passing lane, wherein a virtual road user trajectory is calculated for the virtual road user, whereupon the fulfillment of the passing possibility condition and/or of the shortening amount is a function of the virtual traffic user trajectory. Thus, a passing possibility, in particular, may be checked in such a way as is known from the prior art, wherein, however, a virtual road user is also considered as a road user in the passing lane, in particular, as an oncoming user in the passing lane. In this case, the virtual road user may be parameterized in the manner of a worst-case scenario, i.e., the least favorable yet likely parameters for the passing process are assumed for the virtual road user. For example, the position of the road user may be selected in such a way that it is located immediately outside the stretch section detectable by the surroundings sensor.

The speed or the speed profile of the virtual road user may be selected on the basis of a driving speed or of the maximum allowable driving speed in such a way that the virtual road user moves toward the motor vehicle on the stretch of road. In this case, a worst-case-scenario may again be assumed, i.e. it may be assumed that the virtual road user is moving at an maximum allowable speed or at a speed increased by a predefined amount relative to the maximum allowable speed.

A passing process may also be disrupted by road users turning onto the navigated section. In such case, it is often not possible for the surroundings sensor to detect the turning road user prior to the turning process, since corresponding turns may be at least partially obscured or since bending roads may leave the detection zone of the surroundings sensor already after a short distance. The passing possibility condition may therefore be fulfilled only when a junction condition is not fulfilled, wherein the junction condition is fulfilled if the surroundings data and/or the predefined map data indicate the presence of a junction and/or an intersection within the required driving distance. In other words, the passing possibility condition is not met, if it is ascertained that a junction or an intersection is situated within the driving distance required for passing. The presence of the junction and/or the intersection may be recognized directly from the surroundings data. It is also possible, however, to draw other, in particular, upstream, indications of junctions or intersections from the surroundings data. For example, road signs that refer to a corresponding junction or intersection may be recognized.

It is possible that at least one piece of road sign information relating to a road sign is ascertained by an object detection in the surroundings data, wherein the passing possibility condition is fulfilled on the basis of the road sign information. The part of the surroundings data relating to the road sign may be detected immediately prior to checking the passing possibility condition; however, it is also possible to utilize pieces of road sign information that have been ascertained by an evaluation of chronologically previously detected surroundings data. As previously explained, a piece of road sign information may specify, in particular, a maximum allowable driving speed or may refer to a junction or intersection ahead.

The detectable stretch section and/or the length of the stretch section may be ascertained on the basis of the surroundings data. If the surroundings sensor detects distances of objects, it may be taken into consideration, for example, how far away objects are, which are classified as part of the stretch of road, i.e., for example, as part of the navigated road. In the simplest case, the length of the detectable stretch section may be ascertained in such a way that it corresponds to the distance to the object furthest away that is classified as part of the stretch of road. Alternatively, it would be possible to fixedly predefine the detectable stretch section or the length of the stretch section. A dynamic adaptation is advantageous, however, since the road profile, i.e. in particular, curves in the stretch of road and inclines and gradients, as well as limitation of the detectable stretch section due to weather conditions may be taken into consideration.

By evaluating the surroundings data, it is possible to ascertain pieces of object information of at least one object, which partly obscures the stretch of road for the surroundings sensor, according to which the detectable stretch section and/or the length of the stretch section is/are ascertained on the basis of the object information. Thus, it may be taken into consideration that portions of the area in front of the motor vehicle may be obscured by surroundings objects, in particular, by the preceding vehicle.

The passing possibility condition may also be fulfilled on the basis of an ascertained width and/or number of lanes of the stretch of road. For example, it may be possible on very narrow stretches of road that a passing is not possible due to the width of the stretch of road, even in cases in which there is no oncoming traffic. On the other hand, it may be possible to pass even in the case of oncoming traffic, for example, if there are multiple lanes in both directions. The number of lanes, a respective driving direction for the lanes, the width of the lanes or of the stretch of road and the like may be ascertained by evaluating the surroundings data and/or they may be derived from map data.

Based on the fulfillment of the passing possibility condition, a vehicle device may be activated for outputting a driver instruction to a driver of the motor vehicle and/or for carrying out a driving intervention. The driver instruction may be a visual, a haptic and/or an acoustic instruction. In this case, it may be ascertained, in particular, whether a driver will presumably carry out a passing process and a warning may be given if the passing possibility condition in this case is not fulfilled. An intention to pass may be recognized, for example, in that a blinker actuated by the driver and/or a torque applied to the steering wheel is detected and evaluated. An alarm tone, for example, may be output as a warning over a loudspeaker of the motor vehicle, or an actuator may be activated in order to transmit a torque to the steering wheel, which counteracts a pulling out of the motor vehicle for passing. The method according to an embodiment of the invention is also useful in situations, however, in which the motor vehicle drives in an assisted, partially automated or highly automated or fully automated manner. In this case, it may be decided by the method according to an embodiment of the invention, in particular, whether or not automatic driving interventions for passing should be carried out.

In addition to the method according to an embodiment of the invention, the application also relates to a motor vehicle that includes a surroundings sensor and a control device, which is configured to carry out the method according to an embodiment of the invention. The control device may be configured to detect the ego data and the surroundings data via the surroundings sensor, to ascertain the preceding-vehicle data on the basis of the surroundings data and to ascertain the passing information on the basis of the preceding-vehicle data and of the ego data. In addition, the passing possibility condition may, as explained, be evaluated by the control device.

The motor vehicle according to an embodiment of the invention may be refined with the features cited for the method according to an embodiment of the invention with the advantages cited therein and vice versa.

Figure 2:
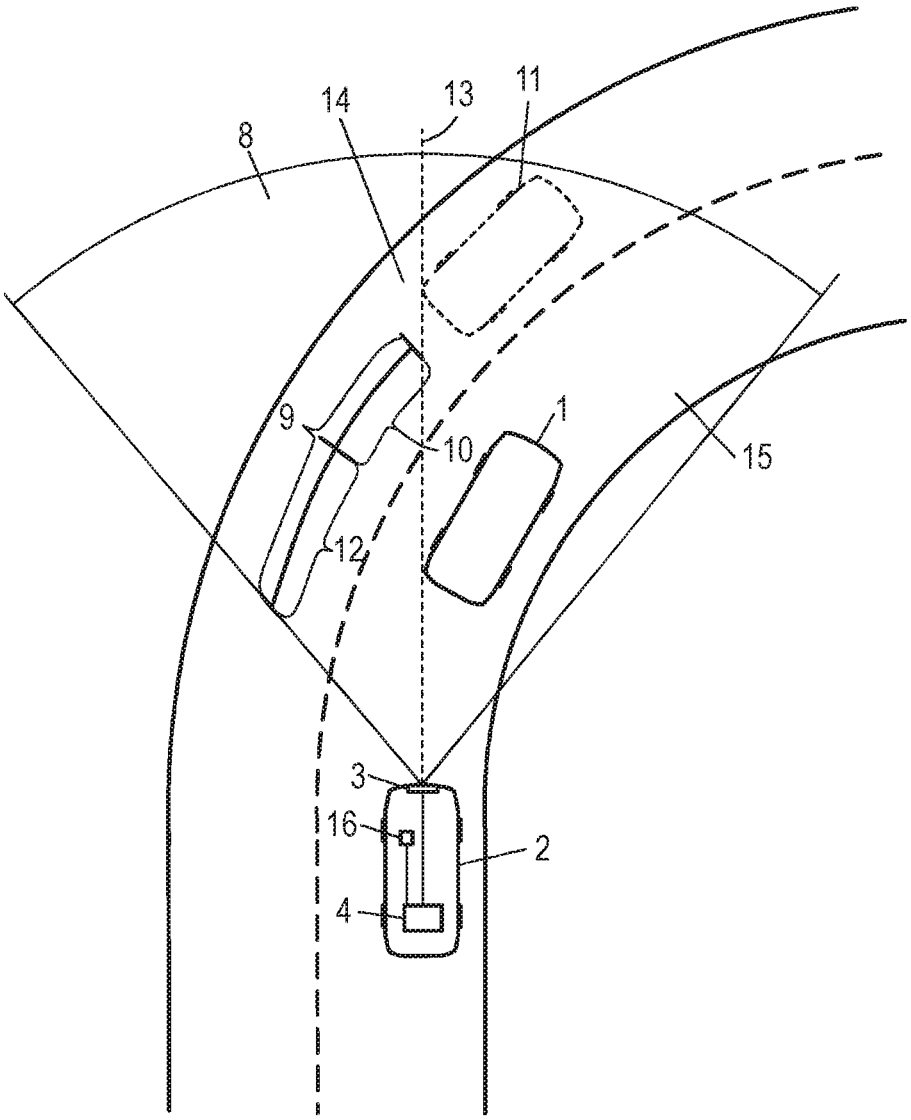
FIG. 2. shows a driving situation near a curve in the stretch of road.

Additional advantages and details are shown by the following exemplary embodiments and by the associated drawings, in which FIGS. 1 and 2 show different driving situations, in which exemplary embodiments of the method according to an embodiment of the invention are carried out by a motor vehicle according to an embodiment of the invention.

FIG. 1 shows a driving situation, in which a motor vehicle 2 approaches a preceding vehicle 1 on a straight stretch of road, wherein the preceding vehicle 1 is to be potentially passed. To assist the driver, it is provided that the surroundings data relating to the stretch of road ahead are detected by a surroundings sensor 3 of the motor vehicle. On the basis of these surroundings data, it is to be ascertained whether in the given traffic situation it is presumably possible to pass the preceding vehicle 1, i.e., whether a passing possibility condition is fulfilled.

For this purpose, ego data are detected by a control device 4 of the motor vehicle 2, which relate to the driving operation of the motor vehicle 2. The ego data detected are an instantaneous driving speed and an instantaneous acceleration of the motor vehicle 2. A maximum acceleration is also projected, in order to ascertain a speed profile of the motor vehicle 2 at maximum acceleration. Based on the surroundings data, the control device 4 also ascertains the preceding-vehicle data relating to the preceding vehicle 1. The preceding-vehicle data ascertained are a speed and an acceleration of the motor vehicle 1. The speed ascertained may be an absolute speed and/or a speed relative to the motor vehicle 2.

A piece of passing information is ascertained on the basis of the preceding-vehicle data and of the ego data, and which describes a minimum required driving distance 6 of the motor vehicle along the stretch of road under predefined boundary conditions, which is required for passing the preceding vehicle. The piece of passing information ascertained may, for example, be a trajectory for the passing process not shown. Alternatively or in addition, it is also possible, however, to determine only one position 5, for example, at which the passing process is completed or a driving distance 6, within which the motor vehicle 2 must stay in a passing lane in the course of the passing process.

Boundary conditions to be considered may, for example be minimum distances of the motor vehicle 2 to the preceding vehicle 1 and/or to an edge of the navigable area. A boundary condition may also be considered to be a maximum allowable driving speed.

The latter may be ascertained, for example, by recognizing road signs 7 in the surroundings data in conjunction with an object recognition and by ascertaining a respective piece of road sign information relating to the road sign, in this case, the allowable driving speed specified by the road sign 7. In this case, signs 7 may of course also be considered, which have been detected at a previous point in time. Alternatively or in addition, it is possible that the motor vehicle 2 includes a position detection device not shown, for example, a GPS sensor. On the basis of the detected position, pieces of information about the instantaneously navigated stretch of road, for example, also a predefined maximum speed, may be derived from map data, which are stored in the motor vehicle 2, or which the motor vehicle 2 accesses via a communication device.

In cases in which an oncoming motor vehicle is detected in the detection zone 8 of the surroundings sensor 3, a distance and a relative speed of the oncoming motor vehicle are ascertained from the surroundings data. From these data, it may be determined whether the oncoming motor vehicle intersects the trajectory of the motor vehicle 2 during the passing process, or whether the oncoming motor vehicle enters within the driving distance 6 required for passing as the motor vehicle 2 passes the preceding vehicle 1. If this is the case, the passing possibility condition is not fulfilled. In conjunction with this determination, a possible acceleration of the oncoming motor vehicle may also be taken into consideration. It may be assumed in this case that the oncoming motor vehicle accelerates at most to a particular maximum speed, which may be ascertained on the basis of the driving speed allowable on the stretch of road.

However, a passing of the preceding vehicle 1, in which no oncoming motor vehicle is detected, is not possible in all cases. This results in the driving situation shown, in particular, from the fact that the length of a stretch section 9 of the stretch of road detectable by the surroundings sensor 3 is limited. This limitation is determined by technical features of the surroundings sensor 3. The detectable stretch section 9 may, for example, also be limited by weather conditions or by a wavy or curvy road profile. To illustrate this, a virtual road user 11 is depicted immediately outside the detection zone 8.

The possibility that road users not yet detectable may enter the detection area 8 is taken into consideration in the explained method, in that the passing possibility condition is fulfilled only if the driving distance 6 required for passing is shorter by a shortening amount 10 than the length of a stretch section 9 of the stretch of road detectable by the surroundings sensor. This threshold for the required driving distance 6 is visualized by the curly brackets 12. In the exemplary embodiment shown, only the required driving distance 6 in the opposite lane or passing lane is considered, since only in this lane is an interaction with oncoming road users to be expected. Alternatively, it would be possible, of course, to take into consideration the entire driving distance required for the passing process, for example the driving distance from the instantaneous actual position of the motor vehicle 2 to the position 5, at which the passing process is completed.

The shortening amount 10 may be fixedly predefined. Preferably, however, it is predefined on the basis of the driving situation. In the simplest case, this may be achieved by predefining the shortening amount 10 on the basis of a maximum allowable speed in the stretch section, which may be ascertained as previously explained.

For example, a duration of the passing process may be ascertained by projecting when the motor vehicle has driven the required driving distance 6 or has reached the position 5. This duration may be multiplied by the maximum allowable driving speed or, however, by an assumed speed for the virtual road user 11 increased by a fixed amount or by a proportionality factor. This corresponds to a worst-case scenario, in which it is assumed that a road user, which is approaching the motor vehicle 2 at high speed, is located immediately beyond the detection zone 8.

In one refinement of the method, it is possible that in conjunction with the evaluation of the passing possibility condition, an existence of a virtual road user 11 is assumed, which is located outside the detected stretch section at the beginning of the passing process and which moves in the passing lane at a predefined speed or with a predefined speed profile. In this case, the passing possibility condition may be evaluated in exactly the same way as for a real road user, which may limit the passing possibility. For example, a virtual road user trajectory may be calculated for the road user 11. The shortening amount may be ascertained on the basis of this road user trajectory, by evaluating which section of the stretch of road is navigated during the passing process by the virtual road user 11.

It is also possible, however, that a corresponding shortening amount is taken only implicitly into consideration in the method. For example, a trajectory for the motor vehicle 2 may be ascertained for the planned passing process and it may be checked whether the road user trajectory and the trajectory of the motor vehicle 2 exhibit a predefined minimum distance in conjunction with the passing process. In this case, the passing possibility condition may be fulfilled. If this minimal distance is not maintained, then the passing possibility condition is not fulfilled. This process also necessarily means that the passing possibility condition is fulfilled only if the driving distance 6 required for passing is shorter by a shortening amount than the length of the stretch section 9 detectable by the surroundings sensor 3. If this is not the case, the trajectories would then intersect.

In the exemplary embodiment shown, an individual surroundings sensor 3 has been utilized in order to detect surroundings data relating to the stretch of road ahead. Multiple identical and/or different types of surroundings sensors may, of course, also be utilized. For example, the stretch ahead may be detected by one or by multiple radar sensors and, additionally, by a camera.

The passing possibility condition may be fulfilled on the basis of other than the sub-conditions explained. For example, the passing possibility condition may not be fulfilled if the presence of a junction is ascertained within the driving distance 6 required for passing. A corresponding junction may mean that during the passing process, additional road users turn into the lane utilized for passing. Depending on the specific turning situation, these additional road users may frequently not be timely recognized by the surroundings sensor 3, which is why a passing in these situations should not be carried out. Junctions or intersections may be recognized by evaluating the surroundings data. In the process, it is possible that the junction or intersection is directly detected or that a warning sign that warns of a corresponding junction or intersection is recognized. It is also possible that the positions of junctions and intersections are derived from map data.

The passing possibility condition may also be a function of a width of the navigated stretch of road or of a number of lanes. A passing may also not be expedient on very narrow stretches of road, even in cases in which there is no oncoming traffic. On the other hand, a passing may also be possible in the presence of oncoming traffic in cases in which, for example, multiple lanes are present in both driving directions.

The result of the passing possibility condition may be utilized in various ways. For example, a vehicle device 16, for example, a display device, for outputting a driver instruction to a driver of the motor vehicle 2, may be activated as a function of the fulfillment of the passing possibility condition. In this case, a driver may be continually informed whether a passing is expedient or that this may occur only in particular driving situations. In a minor variation of this method, the control device 4 may evaluate whether a passing process is presumably planned. This may be ascertained, for example, on the basis of a speed of the motor vehicle 2 relative to the preceding vehicle 1, the setting of a blinker and/or of steering torques or steering angles. If a corresponding intention to pass is ascertained and the passing possibility condition is fulfilled, a visual, acoustic or haptic warning signal may then be given to the driver. For example, an alarm tone may be output or steering torque may be transmitted to the steering wheel counteracting the steering direction for pulling out. The described method may also be utilized, however, in conjunction with an assisted or automated guiding of the motor vehicle 2. In this case, for example, actuators for carrying out a driving intervention may be activated as a function of the fulfillment of the passing possibility condition.

As previously mentioned, the stretch section of the stretch of road detectable by the surroundings sensor 3 may also be limited by a geometry of the stretch of road. It is also possible that the detectable stretch section is further limited by objects, in particular, also by the preceding vehicle 1, which obscures portions of the stretch of road. An example of this is depicted in FIG. 2. In this case, the same reference numerals as in FIG. 1 are used and the explanation is limited to the differences from FIG. 1.

In the traffic situation shown in FIG. 2, the motor vehicle 2 is located before a curve in the stretch of road at a relatively short distance behind the preceding vehicle 1. Thus, a large part of the detection zone 8 of the surroundings sensor 3 is unusable, since the preceding vehicle 1 is blocking this detection zone. Thus, only the stretch section 14 to the left of the dashed line 13 is detectable by the surroundings sensor 3. Road users located in the stretch section 15 to the right of the dashed line 13 are therefore unable to be detected by the surroundings sensor 3.

To enable a process as explained with respect to FIG. 1, in which the detectable stretch section 9 is shorted by a shortening amount 10 or in which the existence of the virtual road user 11 directly outside the detectable stretch section 14 is assumed, it is first ascertained which stretch section 14 is even detectable. The dimensions of the detection zone 8 may be already stored in the control device 4, for example, since they may already be ascertained during the manufacture of the motor vehicle 2. Alternatively, it would be possible to determine these dimensions in conjunction with the normal driving operation, for example, by recognizing in each case maximum distances to detected objects or the like.

The obscuring of the stretch section 15 may be recognized in that for at least one object, in this case for the preceding vehicle 1, pieces of object information are ascertained, namely, in particular, its dimensions or the spatial angle of the detection zone 8 covered by the object. The geometry of the stretch of road is also detected. The geometry of the stretch of road may be ascertained from the surroundings data themselves, for example, by classifying particular sections in the detection data as stretch portions, or they may be derived from digital map data. The detectable stretch section 14 may be ascertained, taking into consideration the stretch of road geometry and the spatial angle of the detection zone 8 blocked by the object, i.e., by the preceding vehicle 1. From this information, it is possible to ascertain the stretch section 9 detectable by the surroundings sensor, or a position for a virtual road user 11 may be predefined, which is located immediately outside the detectable stretch section 9.

If, as explained with regard to FIG. 1, the detectable stretch section 9 is shortened by a shortening amount 10, then the length of the remaining stretch section shown by the curly brackets 12 in the driving situation shown in FIG. 2 is clearly not long enough to enable a passing of the preceding vehicle 1. The passing possibility condition is therefore not fulfilled.

The invention claimed is:

1. A method for checking a passing possibility condition for a motor vehicle, comprising:

detecting, by a surroundings sensor, surroundings data relating to a stretch of road ahead;

determining, by a control device of the motor vehicle, a passing information describing a minimum required driving distance of the motor vehicle along the stretch of road under specific boundary conditions, which is required for passing a preceding vehicle; and evaluating, by the control device, the passing possibility condition based on the passing information and the surroundings data, wherein detecting the surroundings data includes detecting a spatial angle of a detection zone covered by an object.

2. The method according to claim 1, wherein the surroundings data includes a detectable stretch section and/or a length of the detectable stretch section.

3. The method according to claim 2, wherein detecting the detectable stretch section and/or the length of the detectable stretch section is based on a plurality of object information of the object, which obscures the detectable stretch section for the surroundings sensor.

4. The method according to claim 1, further comprising:

detecting, by the control device of the motor vehicle, ego data relating to a driving operation of the motor vehicle;

determining, by the control device of the motor vehicle, preceding vehicle data relating to a preceding vehicle based on the surroundings data, determining, by the control device of the motor vehicle, the passing information based on the preceding vehicle data and the ego data.

5. The method according to claim 1, wherein evaluating the passing possibility condition leads to fulfillment if neither surroundings data or a predefined map data indicates a presence of a junction and/or of an intersection within the required driving distance.

6. The method according to claim 1, wherein evaluating the passing possibility condition is based on a road user information describing another vehicle that is present in a passing lane determined by the surroundings data.

7. The method according to claim 1, wherein the evaluating the passing possibility condition includes fulfilling the passing possibility condition when no road user is detected in a passing lane and a required driving distance is less than a length of a detectable stretch section by a predefined amount.

8. The method according to claim 7, wherein the predefined amount is predefined based on a maximum allowable driving speed.

9. The method according to claim 1, wherein evaluating the passing possibility condition further comprises:

calculating a virtual road user trajectory for a virtual road user, wherein an existence of the virtual road user is assumed, which is located outside a detectable road section at a beginning of the passing, and which moves at a predefined speed or at a predefined speed profile in a passing lane.

10. The method according to claim 9, further comprising:

selecting the predefined speed or the predefined speed profile of the virtual road user based on a driving speed or a stretch of road, wherein a maximum driving speed is determined in such a way that the virtual road user moves toward the motor vehicle on the stretch of road.

11. The method according to claim 1, wherein the evaluating the passing possibility condition further comprises:

determining a road sign information relating to a road sign, the determining including recognizing the object in the surroundings data.

12. The method according to claim 1, wherein the evaluating the passing possibility condition is also based on width and/or number of lanes of the stretch of road.

13. The method according to claim 1, further comprising:

activating a vehicle device to provide at least one of:

outputting a driver instruction to a driver of the motor vehicle; and carrying out a driving intervention as a function of the fulfillment of the passing possibility condition.

14. A motor vehicle comprising:

a surroundings sensor configured to:

detect surroundings data relating to a stretch of road ahead; and a control device configured to:

determine a passing information describing a minimum required driving distance of the motor vehicle along the stretch of road under specific boundary conditions, which is required for passing a preceding vehicle; and evaluate a passing possibility condition based on the passing information and the surroundings data, wherein to detect the surroundings data, the surroundings sensor is configured to detect a spatial angle of a detection zone covered by an object.

* * * * *